United States Patent [19]

Gentz

[11] 4,087,868

[45] May 9, 1978

[54] SPRAY APPARATUS FOR TOILET

[76] Inventor: Paul Gentz, 2500 E. LasOlas Blvd., Ft. Lauderdale, Fla. 33301

[21] Appl. No.: 709,496

[22] Filed: Jul. 28, 1976

[51] Int. Cl.[2] ..... A47K 3/22

[52] U.S. Cl. ..... 4/7; 4/6; 4/406; 4/DIG. 3; 4/217; 4/236; 4/240

[58] Field of Search ..... 4/6, 7, 100, 237, 217, 4/240, 234, 236

[56] References Cited

U.S. PATENT DOCUMENTS

| | | | |
|---|---|---|---|
| 2,164,320 | 7/1939 | Groeniger | 4/217 |
| 2,759,197 | 8/1956 | Majauskas | 4/213 |
| 2,875,450 | 3/1959 | Umann | 4/7 |
| 2,957,180 | 10/1960 | McMullen | 4/7 |
| 3,015,826 | 1/1962 | Aranas | 4/7 |
| 3,334,359 | 8/1967 | Weingartner | 4/100 X |
| 3,491,382 | 1/1970 | Poister | 4/217 |
| 3,533,112 | 10/1970 | Poister | 4/217 |
| 3,594,826 | 7/1971 | Maurer | 4/7 |
| 3,619,820 | 11/1971 | Cain et al. | 4/9 |
| 3,995,326 | 12/1976 | Umann | 4/7 |

*Primary Examiner*—Henry K. Artis
*Attorney, Agent, or Firm*—Oltman and Flynn

[57] ABSTRACT

The present apparatus for a toilet has the following features:

(1) a spray conduit in a recess in the bottom of the toilet seat at the back;

(2) a fluid-tight, rotatable water supply fitting aligned with the hinge axis of the toilet seat and connecting the spray conduit in the seat to an external water pipe;

(3) a switch-operated valving arrangement for purging the spray conduit in the seat of standing water and filling it with hot water, and then causing the spraying operation to take place;

(4) a switch-operated mechanism for flushing the toilet;

(5) a pressure switch in the toilet seat to prevent spraying or flushing except when the seat is down and a person is seated on it; and (6) wiring extending through a tubular safety frame for the toilet to switches at the front for the valving arrangement and the toilet flushing mechanism.

23 Claims, 8 Drawing Figures

SPRAY APPARATUS FOR TOILET

BACKGROUND OF THE INVENTION

Various types of spray apparatus for use at a toilet have been proposed heretofore in which one or more spray pipes are arranged to spray a person seated on the toilet.

U.S. Pat. No. 2,875,450 to Umann is an example of a prior apparatus of this general type. Other such examples are shown in the following U.S. Pat. Nos.: Umann 3,247,524; McMullen 2,957,180; Guidetti 1,866,930; Guidetti 1,887,679; Conterno 2,600,619; Kahn 1,835,497; Salvoni 2,080,438; Zoberg 3,430,268; Thomas 1,886,920; and Jauregui 1,988,737.

In general, such prior proposals have been relatively complicated, expensive, or not sufficiently versatile and easy to use by a hospital or nursing home patient or by an elderly, physically handicapped or sick person at home.

SUMMARY OF THE INVENTION

This invention relates to a toilet spray apparatus for personal hygiene, particularly for use by patients in hospitals and nursing homes or persons having a physical infirmity tending to make personal hygiene somewhat difficult.

In the preferred embodiment, the present spray apparatus includes a water conduit which is recessed into the bottom of the toilet seat at the back and provides a spray discharge at each side. This spray conduit in the seat is connected to a fluid-tight, rotary water supply fitting located at one side of the toilet seat at the back in alignment with the hinge axis of the toilet seat.

In this preferred embodiment, the water supply to the spray apparatus on the seat is controlled by an electrically-operated valving arrangement which may be operated to purge the spray apparatus of standing water and fill it with hot water before using it for spraying purposes. This insures that the user will not spray himself or herself with water that has become too cool for comfort as a result of standing for awhile in a water line (which usually would be several feet in length). The valving apparatus preferably includes a thermostatic mixing valve for supplying warm water at a predetermined temperature for spraying purposes.

In accordance with an important aspect of this invention, the valving arrangement is controlled by manual or foot-operated switches which are positioned for convenient operation by a person sitting on the toilet, so that he or she may purge the spray apparatus of standing water and fill it with hot water immediately before actuating the spray discharge. Preferably, also, the usual internal or external flush valve of the toilet may be actuated by a similar switch located close to the other switches. This enables the person sitting on the toilet to flush the toilet at the completion of the spraying operation. Preferably, the switches are located at the front of a tubular safety frame for the toilet, and the wiring for the switches extends through the hollow interior of this frame.

Preferably, the toilet seat carries a normally-open pressure switch on the bottom which is closed by the weight of a person on the seat when it is down but cannot be closed manually by a small child when the seat is up. This pressure switch prevents the manual or foot switches from operating the valving arrangement for the spray apparatus or the toilet flush valve as long as the pressure switch is open.

A principal objection of this invention is to provide a novel and improved toilet spray apparatus for personal hygiene.

Another object of this invention is to provide such an apparatus which may be conveniently operated by a person sitting on the toilet.

Another object of this invention is to provide such an apparatus which may be connected to the usual hot and cold water lines coming into a bathroom washstand and requires no supplemental heater for the water.

Another object of this invention is to provide such a spray apparatus having a novel arrangement for avoiding an initial spray that is too cool for comfort.

Another object of this invention is to provide such a spray apparatus which does not require any modification of the toilet bowl itself since the spray conduit is carried by a toilet seat that replaces the standard toilet seat and is hinged in the same manner to the toilet bowl at the back.

Another object of this invention is to provide a novel spray apparatus as just mentioned which has a fluid-tight, rotary water supply fitting that is aligned with the hinge axis of the toilet seat at one side so as to permit the seat to be raised and lowered without interference from the spray apparatus on the seat.

Another object of this invention is to provide a novel toilet spray apparatus for personal hygiene which is operated by switches located convenient to a person sitting on the toilet and having associated with it an arrangement for flushing the toilet from a similarly located switch.

Further objects and advantages of this invention will be apparent from the following detailed description of certain presently-preferred embodiments thereof, shown in the accompanying drawings in which.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figure 1:
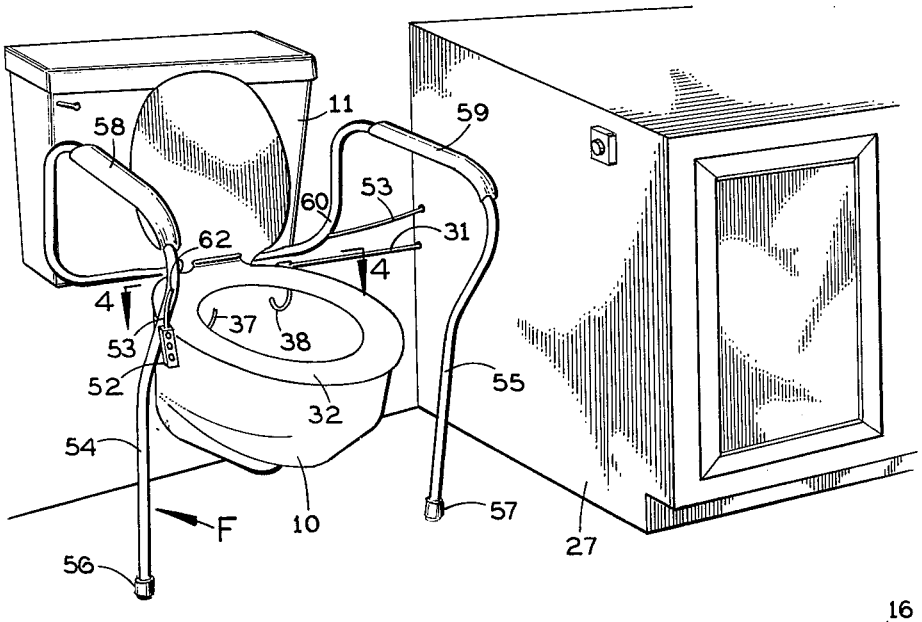
FIG. 1 is a perspective view of a toilet embodying the present spray apparatus and part of an adjacent washstand cabinet.

Referring first to FIG. 1, the toilet is shown as comprising a toilet bowl 10 connected to a conventional flush tank 11. The flush tank has a pivoted outlet valve 12 (FIG. 2) of known design connected to the lower end of a bead chain 13. The upper end of this chain is connected to the usual pivoted lever 14 located inside the flush tank at the top and connected at its pivot 14*a* to the usual pivoted operating handle 15 in front of the flush tank near the top. The flush mechanism also includes a float-operated inlet valve and an overflow tube, both of conventional design and not shown in the drawings in order to simplify them. The toilet may be flushed in the usual manner by rocking the operating handle 15 counterclockwise about the pivot 14*a*, which is carried by a post 24 extending up from a housing 18 inside the tank.

In accordance with one aspect of the present invention, this conventional internal flush valve of the toilet may be operated by a switch located convenient to a person seated on the toilet. This makes it unnecessary for the person to reach back for the handle 15 in order to flush the toilet.

Figure 2:
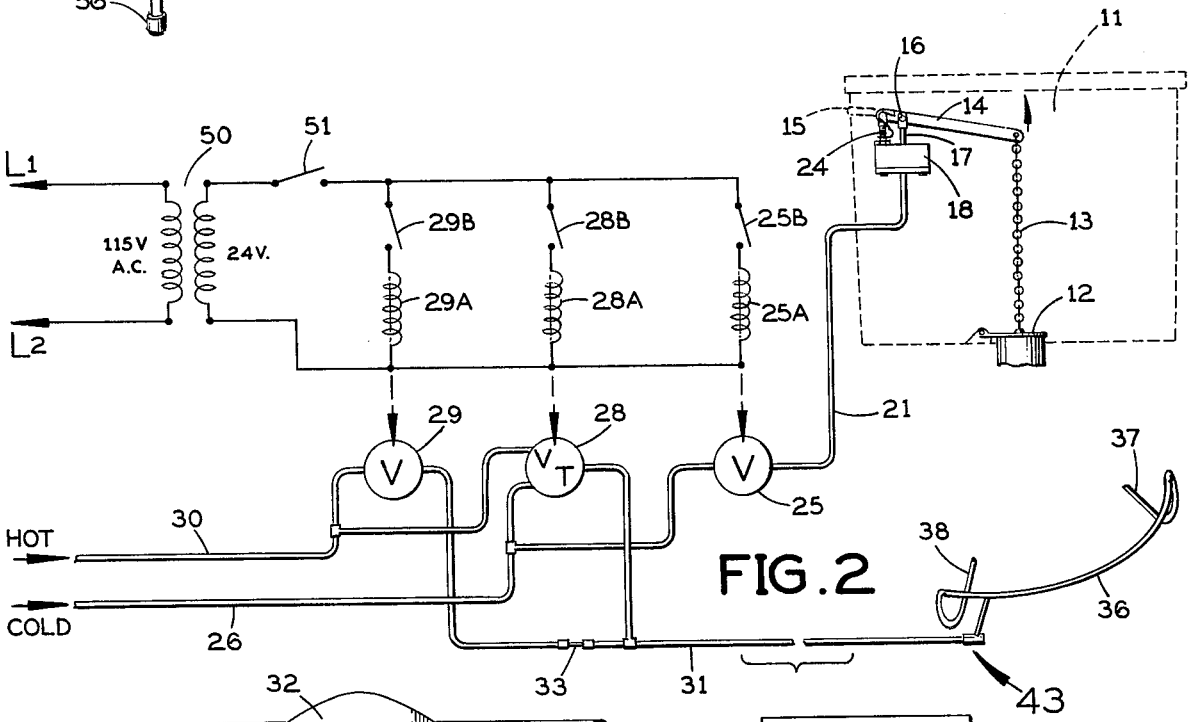
FIG. 2 shows schematically the switch-operated valving arrangement in the present apparatus on a toilet having an internal flush valve.
Figure 6:
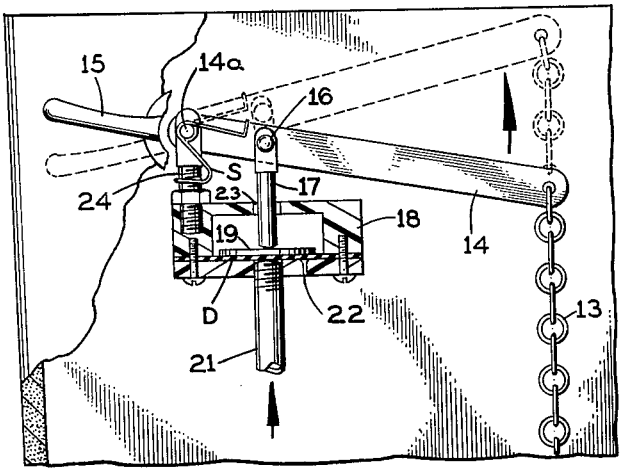
FIG. 6 shows the water-operted apparatus for operating the internal flush valve of the toilet.

Referring to FIGS. 2 and 6, the operating lever 14 for the toilet flush valve is pivotally connected at 16 to the upper end of a vertically slidable, rigid rod 17 extending up loosely through an opening 23 in the top of housing 18. The lower end of the rod 17 is engaged by a rigid plate 19 (FIG. 6) which rests on top of a flexible and resilient diaphragm D of rubber or rubber-like material inside the housing 18. The housing has a pressure inlet 20 at the bottom to which a water conduit 21 is connected at one end. With this arrangement, when water under pressure is supplied to the conduit 21 the diaphragm moves up from the normal, full-line position in FIG. 6 to the phantom-line position, moving the rod 17 up to pivot the operating lever 14 counterclockwise for flushing the toilet.

The clearance between the top opening 23 and the rod 17 enables the diaphragm to move up promptly in response to water pressure at the inlet 20. A bottom vent opening 22 in housing 18 enables the diaphragm to return atuomatically to the normal, lowered position following the flushing of the toilet. A return spring S is provided on the lever 14 to assist in returning the parts to the full-line position of FIG. 6.

It will be understood that, if desired, the flexible diaphragm may be replaced by a piston or other suitable movable pressure-responsive element.

As shown in FIG. 2, the conduit 21 is connected to the outlet of a valve 25 which has its inlet connected to a cold water line 26. Preferably, this valve 25 and its connection to the cold water line are located inside the cabinet 27 (FIG. 1) of a washstand in the bathroom.

In the preferred embodiment, the valve arrangement in the present invention includes, in addition to the valve 25, a thermostatic mixing valve 28 and a purging valve 29, both of conventional design, the details of which are not part of the present invention. The mixing valve 28 has two inlets, one connected to the cold water line 26 and the other connected to a hot water line 30 inside the washstand cabinet 27. The purging valve 29 has a single inlet, which is connected to the hot water line 30. Both valves 28 and 29 have their respective outlets connected to a conduit 31 leading from the washstand cabinet 27 to a spray apparatus on the toilet seat 32 as shown in FIG. 1. A flow restriction 33 (FIG. 2) is provided between the outlet of the purging valve 29 and the conduit 31. If desired, this flow restriction may be built into the valve 29.

Figure 3:
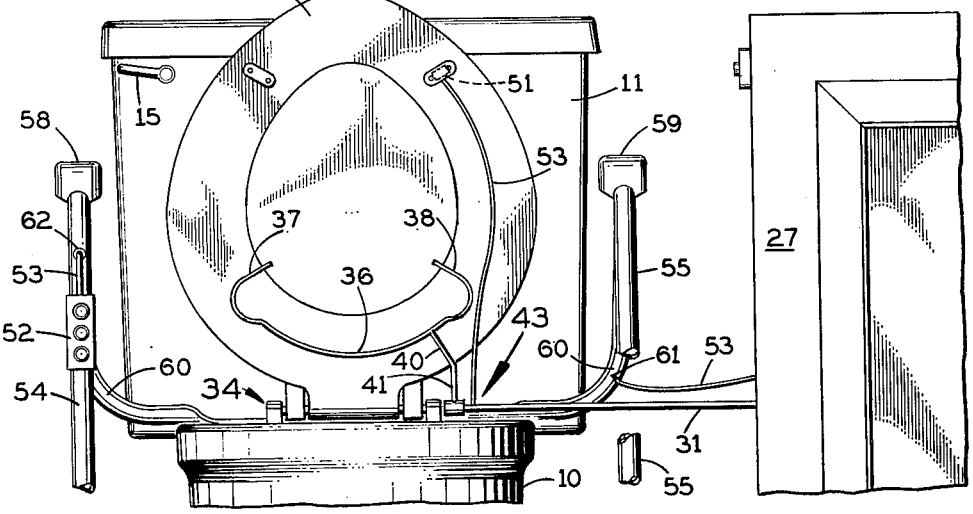
FIG. 3 is a front elevational view of the FIG. 1 toilet arrangement with the seat raised.
Figure 4:
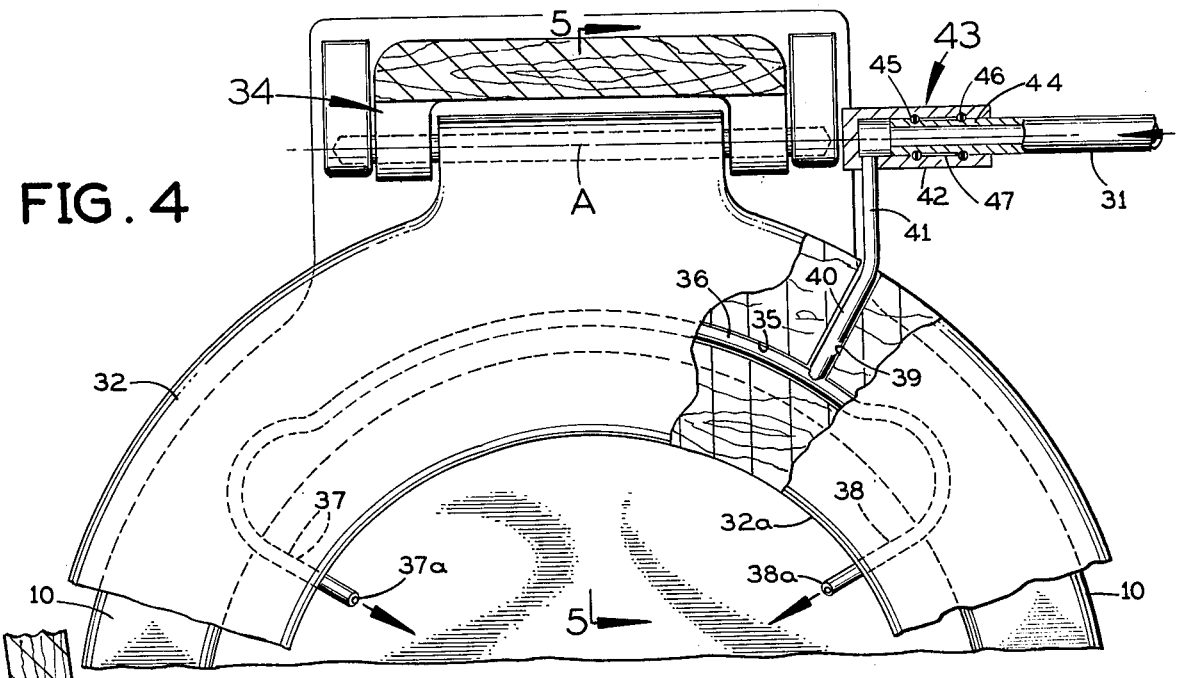
FIG. 4 is an enlarged plan view of the bottom of the toilet seat at its hinged back end, with certain parts broken away for clarity.
Figure 5:
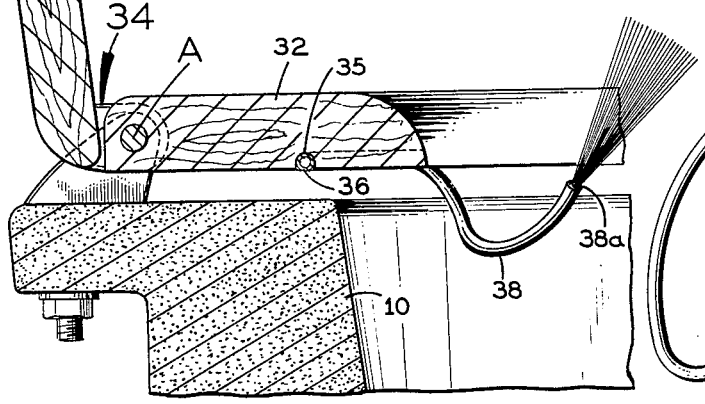
FIG. 5 is a vertical section taken along the line 5—5 in FIG. 4.

Referring to FIGS. 3 and 4, the toilet seat 32 is hinged to the top of the toilet bowl 10 at the back by a toilet seat hinge 34 of conventional design. The bottom face of the toilet seat is formed with an arcuate groove 35 at the back which snugly receives a correspondingly curved portion 36 of a spray conduit, as shown in FIGS. 4 and 5. This spray conduit has curved opposite end segments 37 and 38, each of which extends down and laterally inward below the bottom face of the toilet seat and then back up inside the inner periphery 32*a* of the toilet seat, as shown in FIG. 5. These end segments of the spray conduit present respective spray discharge openings 37*a* and 38*a*, which discharge water upward at acute angles laterally inward and forward at locations a short distance inward from the inner peripheral edge 32*a* of the toilet seat.

At the right side of the hinge 34 in FIG. 4, the toilet seat is formed with a short, straight transverse groove 39 on the bottom which extends from the outer periphery of the seat into the curved groove 35. The spray conduit has a short, straight inlet segment 40 which is snugly seated in this groove and intersects the curved segment 36 of the spray conduit to supply water to the latter. Another short straight segment 41 of the spray conduit extends back from the inlet segment 40 parallel to the longitudinal (front-to-back) axis of the toilet seat. The back end of this conduit segment 41 is connected rigidly to the cylindrical outer sleeve 42 of a water supply fitting 43. The left end of this outer sleeve is closed and the right end is open. The sleeve 42 is coaxial with the pivot axis A of the toilet seat hinge 34.

The water supply fitting 43 also has a cylindrical inner sleeve 44 which is snugly, but rotatably, received in the outer sleeve 42. A pair of O-rings 45 and 46 of rubber-like material are engaged between the outer and inner sleeves on opposite sides of a circumferential groove 47 in the latter to provide a water-tight seal between the outer and inner sleeves. The outer (right) end of the inner sleeve 44 is soldered, brazed or otherwise attached in fluid-tight fashion to the end of the water supply conduit 31 extending from the washstand cabinet 27 over to the right side of the toilet in FIG. 1.

With this arrangement, the toilet seat may be pivotally raised or lowered about the axis A of its hinge 34, and the outer sleeve 42 of the fitting rotates in unison with the toilet seat about this axis. The inner sleeve 44 of the fitting remains stationary, and the O-rings 45 and 46 prevent water leakage between the two sleeves.

Referring again to FIG. 2, the three valves 25, 28 and 29 are normally-closed solenoid valves having respective solenoids 25A, 28A and 29A, which are connected in series with respective normally-open switches 25B, 28B and 29B. The series-connected switch 25B and solenoid 25A are connected in parallel with the series-connected switch 28B and solenoid 28A and in parallel with the series-connected switch 29B and solenoid 29A across the 24 volt secondary of a step-down transformer 50 through a normally-open switch 51. The transformer has its primary connected across the terminals of a plug which may be inserted in one of the usual 115 volt A.C. power sockets in the bathroom. Preferably, the transformer 50 is located in the washstand cabinet 27, as are the solenoids and their respective valves 25, 28 and 29.

The normally-open switch 51 preferably is located on the bottom of the toilet seat, such as at one of the bumpers near the front (FIG. 3) which rest on the top of the toilet bowl 10 when the seat is down. A predetermined force, such as 20 pounds, is required to close the switch 51. With this arrangement, the switch 51 closes when a person sits on the seat and it opens automatically when the person gets off the seat. The force required to close switch 51 is sufficiently great that it cannot be closed manually by a child or other mischievous person when the seat is in its raised position.

It will be evident from FIG. 2 that none of the valves 25, 28 and 29 can be opened except while the seat switch 51 is closed. In addition, the valves are controlled individually by the respective switches 25B, 28B and 29B, which control separately the energization of the valve solenoids 25A, 28A and 29A, respectively.

In the embodiment shown in FIGS. 1–6, the three valve switches 25B, 28B and 29B are in a small housing 52 (FIG. 1) located at the left front of the toilet. The switches are operated by respective push buttons projecting from this housing. The electrical wiring for the three valve switches is contained in a unitary cable 53 to which the switch housing 52 is physically attached at one end.

The wiring cable 53 extends through the hollow interior of a tubular metal safety frame F of known design which is located at the toilet for the convenience and safety of an aged or infirm person. In the particular example shown, this safety frame has opposite front legs 54 and 55 having rubber feet 56 and 57 at the bottom which rest on the floor, opposite padded arms 58 and 59, and a generally U-shaped back end segment 60 which extends down from the respective arms and behind the toilet seat hinge 34 in front of the toilet tank 11 near its lower end.

Alternatively, the safety frame may be mounted on the toilet seat 32, in which case it would not have floor-engaging legs.

The wiring cable 53 extends from the transformer 50 located in the washstand cabinet 27 (FIG. 1) laterally over into the back end segment 60 of the safety frame at an entry opening 61 located at the latter's right side in FIG. 1. From this entry point in the safety frame the wiring cable extends longitudinally along the hollow interior of the safety frame to an opening behind the water supply fitting 43, where it emerges as shown in FIG. 3 for connection to the seat switch 51 on the bottom of the toilet seat near the front. Preferably, this portion of the wiring cable is seated in a recess in the bottom of the toilet seat or an internal passageway in the seat. From the seat switch 51 the wiring cable 53 re-enters the back end segment 60 of the safety frame at the same location and it passes to the left in FIGS. 1 and 3 and up into and along the inside of the left arm 58, emerging at an opening 62 at the front end which is so located as to make the switch housing 52 conveniently accessible to a person sitting on the toilet.

In the use of this apparatus, when the toilet seat 32 is down and a person sits on it, his or her weight closes the seat switch 51. The other three switches 25B, 28B and 29B remain open until operated manually. The preferred sequence of switch operation is as follows:

(1) The person seated on the toilet manually closes switch 29B, thereby completing the energization circuit for the valve solenoid 29A, which now opens the purge valve 29. The purge valve passes hot water from the inlet line 30 to the spray conduit 36–38 on the toilet seat. The flow restriction 33 prevents a spraying action at the discharge openings **37*a* and 38*a* but permits the water to dribble out of these openings without touching the person seated on the toilet. In this manner, the spray conduit 36–38 on the toilet seat and the supply conduit 31 leading to it are purged of standing water which usually will have become too cool for personal comfort if sprayed onto the person seated on the toilet, and the supply conduit 31 and spray conduit 36–38** become filled with hot water, which heats these conduits.

(2) After the cool standing water has been purged, as described, the user releases switch 29B, permitting it to re-open, and he now manually closes the spray switch 28B. This completes the energization circuit for the solenoid 28A, which now opens the thermostatic mixing valve 28. Valve 28 passes warm water at a predetermined temperature to the supply conduit 31 and the spray conduit 36–38 on the toilet seat. This water is sprayed out of the discharge openings **37*a* and 38*a* onto the person seated on the toilet at a sufficiently high pressure and velocity to provide an effective and thorough cleansing operation. Whenever the user releases the push button or other actuator for the spray switch 28B**, this spraying operation ceases.

(3) When the spraying operation is over (or at any other time desired) the user may flush the toilet by closing the switch 25B, thereby completing the energization circuit for the solenoid 25A which opens the valve 25. When this happens, cold water under pressure is supplied to the diaphragm D to flush the toilet in the manner already described.

Figure 7:
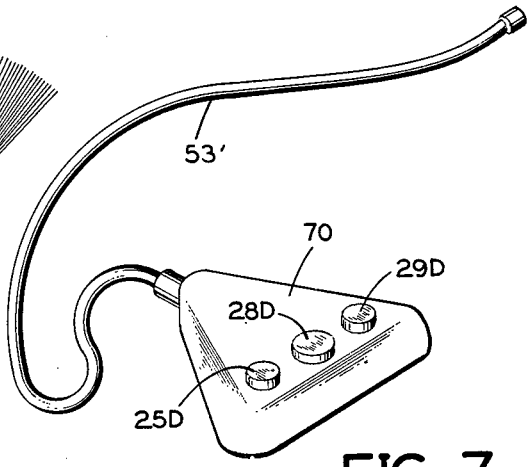
FIG. 7 is a perspective view showing foot-operated switches for operating the valving arrangement of FIG. 2 (in place of the manual switches shown in FIG. 1)

Referring to FIG. 7, the manual switches described may be replaced by foot operated switches located in a housing 70, which rests on the floor at the front of the toilet, and having respective push buttons 25D, 28D and 29D. With this arrangement the wiring cable 53 has an extension 53' extending from the safety frame down to the switch housing on the floor. In other respects, the apparatus would be identical to the arrangement already described in detail.

Figure 8:
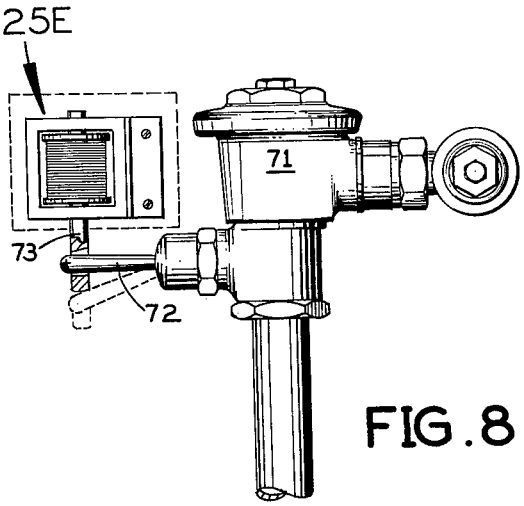
FIG. 8 shows a solenoid operating an external flush valve for the toilet (in place of the internal flush valve shown in FIGS. 2 and 6).

FIG. 8 shows another modification for use with a toilet which has an external flush valve 71 instead of the internal flush valve and water tank previously described. This external flush valve is of conventional design and it has the usual pivoted operating handle 72 at one side.

In accordance with the present invention, this operating handle for the flush valve is suitably coupled mechanically to the vertically reciprocable plunger 72 of a solenoid 25E, which corresponds to the solenoid 25A in FIG. 2. Thus, when the switch 25B (either hand-operated or foot-operated) is closed, the solenoid 25E is energized, pushing down the plunger 72 to rock the handle 72 so as to open the flush valve 71.

The purge valve 29 and the spray valve 28 may be combined in a unitary valve assembly which performs their separate functions in the manner described or else automatically in sequence. In the latter case, only a single switch would be required to initiate the sequential operations of purging the conduits of standing water and then spraying.

From the foregoing description it will be apparent that the disclosed embodiments of this invention are devised for the convenience and safety of the user, minimizing the need for a nurse or other attendant to assist the user. The location of the valve switches, whether hand-operated or foot-operated, enables the user to initiate several different functions of the apparatus at the user's convenience and without requiring significant physical effort on his or her part. The provision of the purging valve avoids any initial discomfort to the user. The apparatus requires no auxiliary heater, and it may be connected directly to the usual cold and hot water lines in the bathroom. The water-tight fitting 43 is the only moving part in the apparatus and it can be made substantially maintenance-free by providing a suitable lubricant in its groove 47, which keeps the rubber-like O-rings 45 and 46 "live" to preserve their ability to provide water-tight seals.

If desired, the spray apparatus may include a suitable arrangement (not shown) for drawing liquid medication into the warm water which is discharged when the spray valve 28 is actuated. This would be for users requiring the application of such medication to the part of the body being sprayed.

It is to be understood that various individual component parts of the complete apparatus disclosed herein may be omitted where the full range of functions is not required. For example, in some cases the safety frame may be omitted, or the switch-operated toilet-flushing mechanism may be omitted, or the arrangement for purging the standing water may be omitted, all without departing from the spirit and scope of this invention.

I claim:

1. For use with a toilet having a seat, the combination of:

water spray means adapted to be mounted on the toilet seat for spraying water onto a selected area of a person sitting on said seat, and a water supply conduit leading to said spray means;

first electrically-operated, normally-closed valve means having a hot water inlet and a hot water outlet which is connected to said water supply conduit, means for limiting the pressure of the water supplied to said conduit by said first valve means to a value insufficient to produce an effective spray discharge at said spray means;

second electrically-operated, normally-closed valve means having an outlet which is connected to said supply conduit for supplying warm water to the latter at a pressure high enough to produce an effective spray discharge at said spray means;

and switch means operatively connected to said first and second valve means to open them separately for supplying water to said supply conduit.

2. The combination of claim 1, and further comprising:

a toilet seat having hinge means at the back for attachment to the toilet, said seat having an elongated recess on the bottom at the back which snugly receives said water supply conduit, said supply conduit extending into said recess from one side of the seat at the back;

and a fluid-tight, rotary water supply fitting attached to said water supply conduit at said one side of the seat, said fitting having a water passage therethrough and having its rotational axis substantially aligned with the hinge axis of the seat.

3. The combination of claim 1, wherein said toilet has a flush valve, and further comprising:

electrically-operated means for opening said flush valve to flush the toilet;

and an additional switch operatively connected to said electrically-operated means for controlling the latter's operation.

4. The combination of claim 3, wherein the toilet has a flush tank containing said flush valve, and said electrically-operated means comprises:

water pressure-operated means for opening said flush valve in the flush tank to flush the toilet;

and a third electrically-operated, normally-closed valve for supplying water from a pressurized water supply to said pressure-operated means.

5. The combination of claim 3, wherein said flush valve has an external handle for operating the valve, and said electrically-operated means comprises:

a solenoid operatively coupled to said handle to open the flush valve when the solenoid is energized by closing said additional switch.

6. The combination of claim 3, wherein said switch means and said additional switch are in close proximity to each other for operation selectively by a person sitting on the seat.

7. The combination of claim 6, and further comprising:

a normally-open pressure switch on the seat which is operable to close when the seat is down on the toilet and a person is sitting on the seat, said pressure switch being operatively connected to said first and second valve means and said electrically-operated means to prevent them from being operated as long as the pressure switch is open.

8. The combination of claim 7, and further comprising:

a toilet seat having hinge means at the back for attachment to the toilet, said seat having an elongated recess on the bottom at the back which snugly receives said water supply conduit, said supply conduit extending into said recess from one side of the seat at the back;

and a fluid-tight, rotary water supply fitting attached to said water supply conduit at said one side of the seat, said fitting having a water passage extending therethrough and having its rotational axis substantially aligned with the hinge axis of the seat.

9. The combination of claim 1, wherein said switch means comprises first and second switches operatively connected individually to said first and second valve means, respectively, and in close proximity to each other for operation selectively by a person sitting on the toilet.

10. The combination of claim 9, and further comprising:

a normally-open pressure switch on the seat of the toilet which is operable to close when the seat is down and a person is sitting on the seat, said pressure switch being operatively connected to said first and second valve means to prevent them from being opened by the respective first and second switches as long as the pressure switch is open.

11. The combination of claim 9, and further comprising:

a toilet seat having hinge means at the back for attachment to the toilet, said seat having an elongated recess on the bottom at the back which snugly receives said water supply conduit, said supply conduit extending into said recess from one side of the seat at the back;

and a fluid-tight, rotary water supply fitting attached to said water supply conduit at said one side of the seat, said fitting have a water passage therethrough and its rotational axis substantially aligned with the hinge axis of the seat.

12. The combination of claim 11, and further comprising:

a normally-open pressure switch on the seat which closes when a person sits on the seat, said pressure switch being operatively connected to said first and second valve means and said electrically-operated means to prevent their operation as long as the pressure switch is open.

13. The combination of claim 3, and further comprising:

a normally-open pressure switch on the seat which closes when a person sits on the seat, said pressure switch being operatively connected to said first and second valve means and said electrically-operated means to prevent their operation as long as the pressure switch is open.

14. For use with a toilet having a seat, the combination of:

water spray means adapted to be mounted on the toilet seat for spraying water onto a selected area of a person sitting on said seat, and a water supply conduit leading to said spray means;

a valve having a hot water inlet and a hot water outlet which is connected to said water supply conduit, means for limiting the pressure of the water supplied to said conduit by said valve to a value insufficient to produce an effective spray discharge at said spray means;

and a switch operatively connected to said valve for opening the latter to supply hot water to purge said supply conduit of standing water and to fill said conduit with hot water.

15. For use with a toilet having a seat and a flush valve for flushing the toilet, the combination of:

water spray means adapted to be mounted on the toilet seat for spraying water onto a selected area of a person sitting on said seat, and a water supply conduit leading to said spray means;

an electrically-operated, normally-closed spray valve for supplying water to said spray means at a pressure sufficient to produce a spray discharge;

a switch operatively connected to said spray valve to open the latter;

electrically-operated means for opening said flush valve to flush the toilet;

and an additional switch operatively connected to said electrically-operated means for selectively operating the latter to open said flush valve to flush the toilet.

16. The combination of claim 15, wherein the toilet has a flush tank containing said flush valve, and said electrically operated means comprises:

water pressure-operated means for opening said flush valve;

and an additional electrically-operated, normally-closed valve for supplying water from a pressurized water supply to said pressure-operated means.

17. The combination of claim 15, wherein said flush valve has an external handle for operating the valve, and said electrically-operated means comprises:

a solenoid operatively coupled to said handle to operate the latter for opening the flush valve when the solenoid is energized by closing said additional switch.

18. The combination of claim 15, wherein said switches are in close proximity to each other for operation selectively by a person sitting on the toilet.

19. The combination of claim 15, and further comprising:

a toilet seat having hinge means at the back for attachment to the toilet, said seat having an elongated recess on the bottom at the back which snugly receives said water supply conduit, said supply conduit extending into said recess from one side of the seat at the back;

and a fluid-tight, rotary water supply fitting attached to said water supply conduit at said one side of the seat, said fitting having a water passage therethrough and having its rotational axis substantially alinged with the hinge axis of the seat.

20. The combination of claim 15, and further comprising:

a hinged seat for the toilet;

and a normally-open pressure switch on the seat which closes when a person sits on the seat, said pressure switch being operatively connected to said spray valve and said electrically-operated means to prevent their operation by the respective switches as long as the pressure switch is open.

21. The combination of claim 20, wherein said switches for the spray valve and said electrically-operated means are in close proximity to each other for operation selectively by a person sitting on the toilet.

22. The combination of claim 21, wherein said seat has hinge means at the back for attachment to the toilet, and further comprising:

means defining an elongated recess on the bottom of the toilet seat at the back which snugly receives said water supply conduit, said supply conduit extending into said recess from one side of the seat at the back;

and a fluid-tight, rotary water supply fitting attached to said water supply conduit at said one side of the seat, said fitting having a water passage therethrough and having its rotational axis substantially aligned with the hinge axis of the seat.

23. The combination of claim 20, wherein said seat has hinge means at the back for attachment to the toilet, and further comprising:

means defining an elongated recess on the bottom of the toilet seat at the back which snugly receives said water supply conduit, said supply conduit extending into said recess from one side of the seat at the back;

and a fluid-tight, rotary water supply fitting attached to said water supply conduit at said one side of the seat, said fitting having a water passage therethrough and having its rotational axis substantially aligned with the hinge axis of the seat.

* * * * *